US005787836A

United States Patent [19]

Blaisdell et al.

[11] Patent Number: 5,787,836

[45] Date of Patent: Aug. 4, 1998

[54] MOULDED BOAT HULL WITH MODULAR INSERT

[75] Inventors: George Blaisdell, Cary; Greg Siewert, Durham, both of N.C.; Roy Rogers, Bradenton, Fla.

[73] Assignee: Allied Logic Corporation, Durham, N.C.

[21] Appl. No.: 801,958

[22] Filed: Feb. 18, 1997

[51] Int. Cl.[6] ..... B63B 5/24

[52] U.S. Cl. ..... 114/357

[58] Field of Search ..... 114/355, 356, 114/357, 358, 56, 57

[56] References Cited

U.S. PATENT DOCUMENTS

| | | | |
|---|---|---|---|
| 3,315,284 | 4/1967 | Ludlow | 114/357 |
| 4,021,874 | 5/1977 | Alter et al. | 114/357 |
| 4,917,037 | 4/1990 | Hargett, Sr. | 114/357 |
| 5,458,844 | 10/1995 | Mac Dougall | 264/310 |
| 5,601,048 | 2/1997 | Mac Dougall | 114/357 |

*Primary Examiner*—Stephen Avila

*Attorney, Agent, or Firm*—Abelman, Frayne & Schwab

[57] ABSTRACT

A moulded boat hull is disclosed which includes a modular liner which is nested within and hermetically sealed to a hollowed moulded plastic boat hull structure. The liner includes the seamless floor section of the boat, which is supported by stiffening members within the boat hull. Substantial flexibility is achieved by permitting the use of alternative liners within the same boat hull, thereby allows customization of the boat.

20 Claims, 3 Drawing Sheets

FIG.5
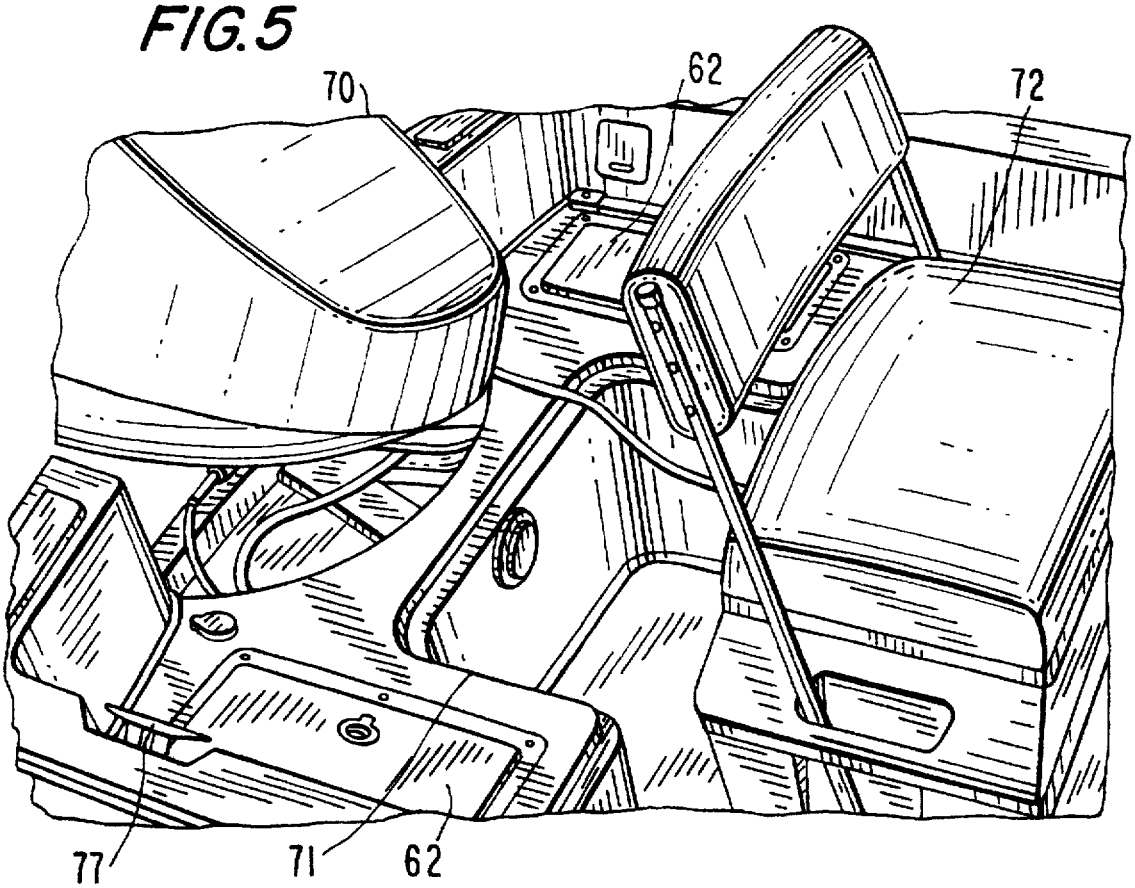
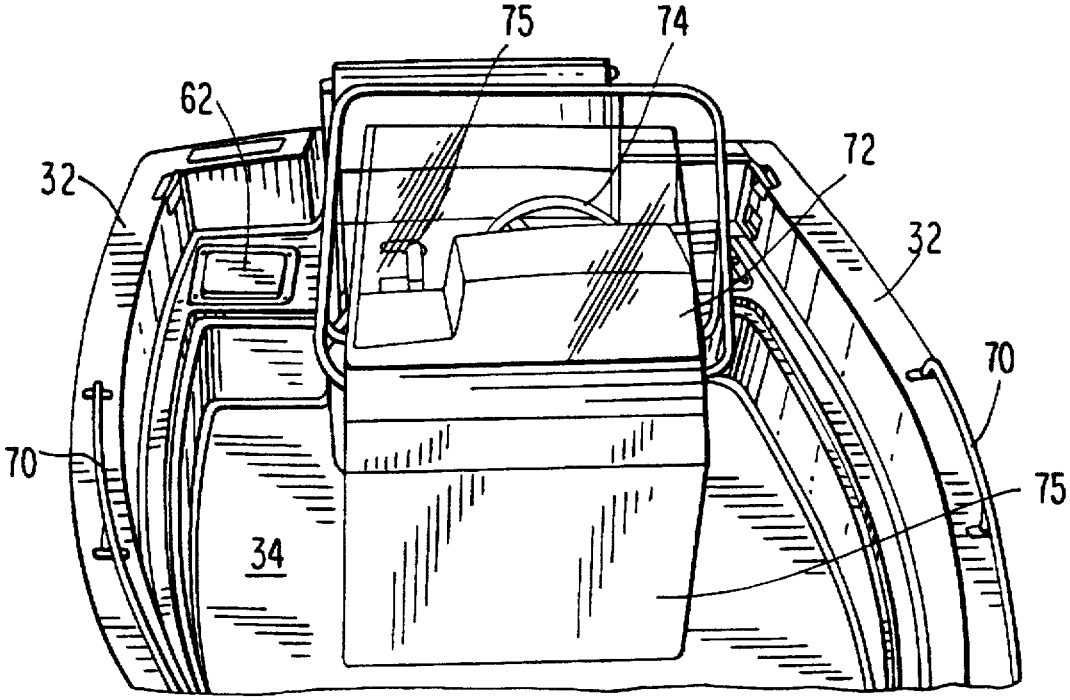
FIG.6

MOULDED BOAT HULL WITH MODULAR INSERT

FIELD OF THE INVENTION

The present application pertains to a unitary boat construction. More particularly, the major boat structure is formed of two unitary members. One of these members, is an integrally moulded hull, preferably of the type which is the subject of U.S. Pat. No. 5,458,844 and No. 5,601,048. The other member is a liner which includes the boat floor and other external components and is nested within, and hermetically connected to, the hull. Accordingly, the hull will act as a receptor for a variety of customized liners according to the requirements of the specific boat structure.

BACKGROUND OF THE INVENTION

The materials of construction for a boat hull require the combination of formability, strength, attractive appearance, low maintenance and durability in the marine environment. Boat hulls meeting these requirements should also be cost efficient to manufacture. In order to avoid the maintenance and deterioration attendant to wooden boat hulls, various plastic materials have become increasingly popular. A particularly advantageous plastic boat hull structure is the subject of U.S. Pat. No. 5,458,844 and No. 5,601,048. Such a hull is rotationally moulded as an integral unit, with appropriate stiffening members to appropriately withstand the anticipated marine forces encountered during prolonged use. Accordingly, it has been found that such rotationally moulded hulls provide a high degree of efficiency, durability and freedom from maintenance.

After forming the hull, the necessary boat components, including flooring, seating, motor mounts, etc., must be inserted within the boat hull. Typically, this has required several parts which are individually inserted within the hull and connected to each other. Specifically, the flooring has been formed of several individual planar members which closely abut at their junctures, with a sealant at such junctures being utilized to hermetically seal the floor expanse.

Recognizing the various disadvantages of the myriad of individual parts which must be connected to the hull to complete the boat structure, and the propensity of the multi-part floor to create bailing and drainage difficulties, the present invention provides an integrally formed liner, which contains the unitary flooring and other interior boat components, and is nested within, and hermetically sealed, to the hull.

SUMMARY OF THE INVENTION

The moulded boat of the present invention includes two basic integrally formed members. The first member is the hull which is preferably rotationally moulded in accordance with aforementioned U.S. Pat. No. 5,458,844 and No. 5,601,048. The hull comprises inner and outer shells which are integrally joined about their periphery, and which are also integrally joined at adjacent regions within the periphery by a plurality of horizontally spaced and longitudinally extending stiffening members. These stiffening members are integrally joined to and extend between the inner and outer shells to establish a generally hollow volume hull. The stiffening members are recessed within the hollow volume and project upwards towards the open region of the hollow volume.

The second member of the boat that is constructed in accordance with the advantageous teachings of the present invention is an integrally formed liner which is nested within the hollow volume of the hull. The liner is customized in accordance with the requirements of the particular boat. That is, a single hull structure may receive several different alternative liners, thereby achieving substantial manufacturing efficiencies and overall flexibility.

The liner includes a vertical wall which extends downwardly along at least a portion of its periphery. A generally horizontally extending bottom wall extends between the opposed lower edges of the peripheral wall. The liner is also appropriately configured to mate with the bow of the hull, mount the seats and motor, include storage and other typical boat components. The bottom wall of the liner abuts, and is supported by the horizontally extending surfaces of the hull stiffening members.

Securement means are provided for fixedly, and hermetically sealing the periphery of the liner to the boat hull. It should be noted that by virtue of the unitary construction of the liner, its recessed bottom wall, which will form the boat floor, is of a seamless construction, thereby providing easier self-bailing and drainage. The hermetic seal between the liner and the boat hull includes an appropriate sealant/adhesive between their opposed peripheral walls. The bottom wall of the liner is also advantageously adhesively secured to the horizontally extending surfaces of the stiffening members.

It has been found advantageous to form the liner of a different plastic material than the boat hull. For example, where the boat hull may be rotationally formed of molten polyethylene powder, the liner may be formed of a fiber-reinforced plastic. In order to provide an optimum seal between the bottom (floor) surface of the liner and the longitudinal stiffening members of the hull, an intermediate saddle is interposed therebetween. The intermediate saddle, which is preferably also constructed of fiber-reinforced plastic, will be of the same longitudinal extent as the liner floor surface. The saddle is adhesively secured to the longitudinal stiffening member utilizing the same adhesives elected to hermetically seal the peripheral wall of the liner to the opposed vertical wall of the hull. Should the saddle and liner be of the same material (e.g., fiber-reinforced plastic), an appropriate sealant is selected to optimize the adhesive connection therebetween. Advantageously, the securement of the saddle to the longitudinal stiffening member may also include a plurality of screws which are inserted such that the saddle will be in shear when loaded, rather than in straight tension. The utilization of the intermediate saddle with its securement to the longitudinal stiffening member provides an extremely solid method for enhancing the anchorage of the liner to the boat hull.

Recognizing the slippery conditions oftentimes encountered during boat utilization, the outer surface of the minor bottom wall, which constitutes the boat flooring, will preferably include an appropriate skid-resistant surface.

Accordingly, it is a primary object of the present invention to provide a simplified, versatile and cost-efficient moulded boat structure.

A further object of the present invention is to provide such a moulded boat structure which includes an integrally moulded plastic boat hull, and an integral liner nested within the hull.

Another object of the present invention is to provide such a moulded boat structure in which the liner is hermetically sealed to the boat hull, with its bottom wall secured to, and supported by longitudinally extending stiffening members within the boat hull.

Yet another object of the present invention is to provide such a moulded boat structure, in which a single boat hull may accommodate different liners, so as to customize the boat construction.

These as well as other objects of the present invention will become apparent upon a consideration of the following description and drawings.

BRIEF DESCRIPTION OF THE DRAWINGS

FIG. 5 is a top, sidewardly directed perspective view of the rear portion of a typical fully assembled boat in accordance with the present invention, and showing the addition of the seat, motor and battery components.

FIG. 6 is a top, rearwardly directed perspective view of the boat of FIG. 5 but with the motor removed.

DETAILED DESCRIPTION OF THE DRAWINGS

Figure 1:
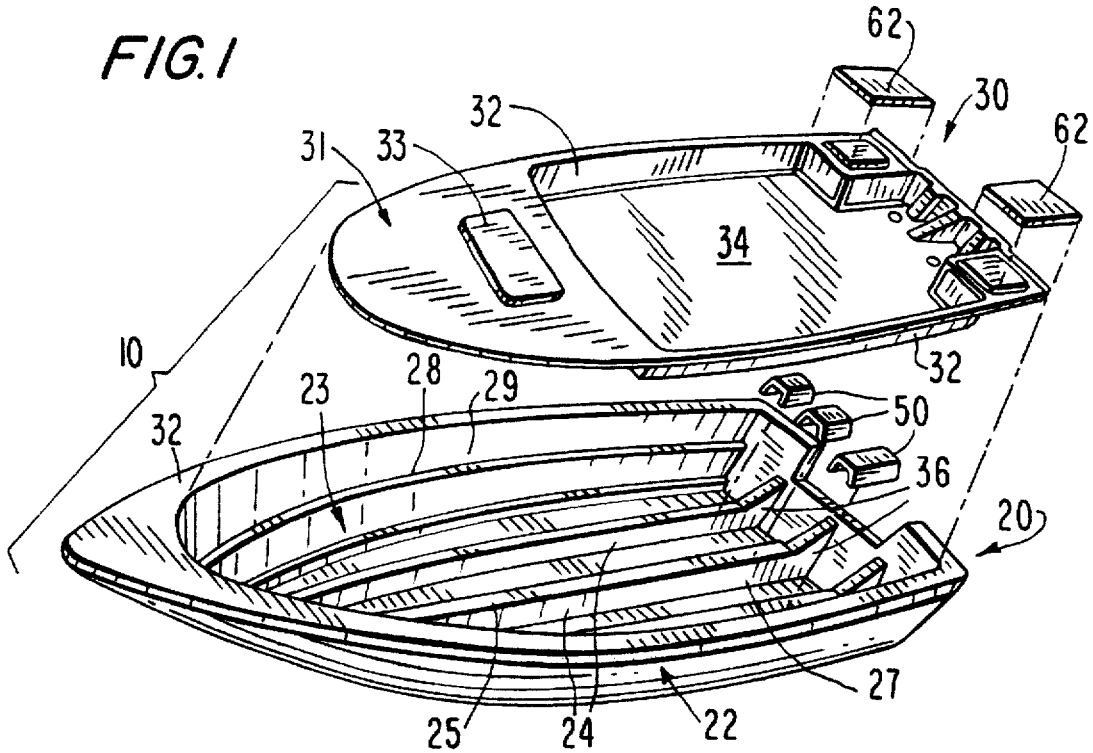
FIG. 1 is an exploded perspective of the basic components forming the moulded boat hull structure of the present invention.
Figure 2:
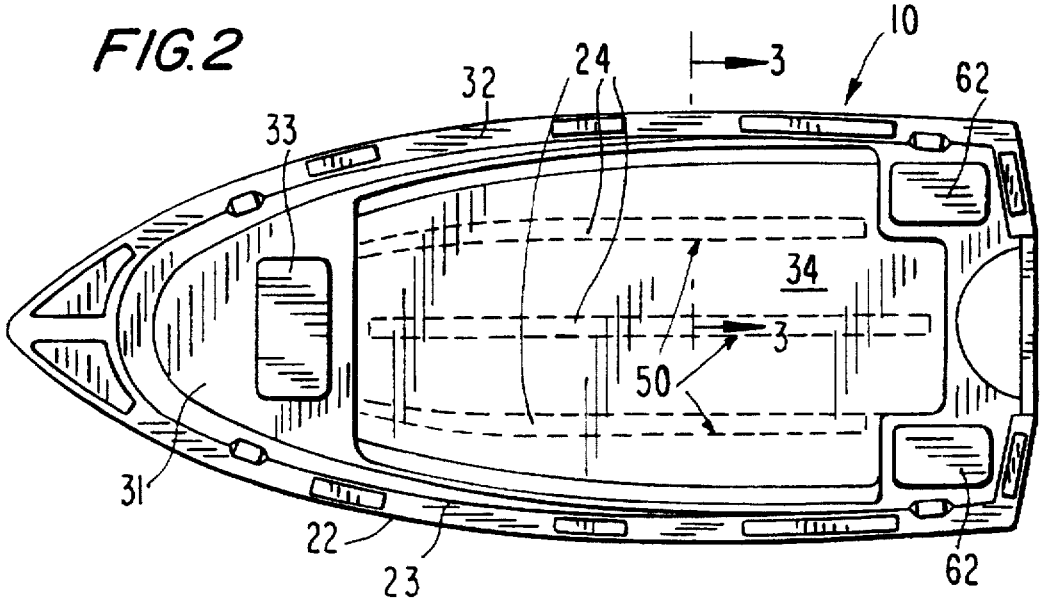
FIG. 2 is a top view of an assembled boat.
Figure 3:
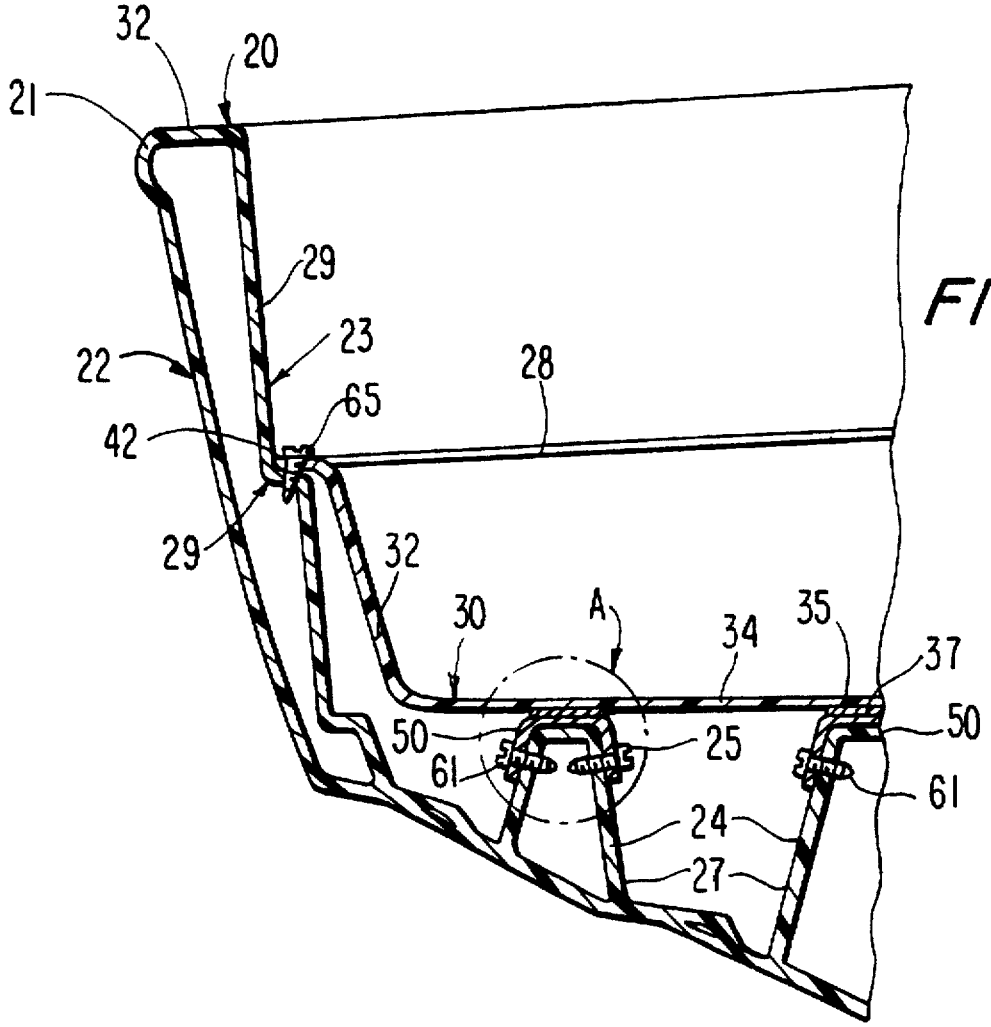
FIG. 3 is a cross-section along the lines 3–3 as shown in FIG. 2.

Reference is now initially made to FIGS. 1–4. The moulded boat, generally indicated as 10, includes two principal members. They are the integrally moulded plastic boat hull structure 20 and integral liner 30 which will be nested within the boat hull structure. As disclosed in aforementioned U.S. Pat. No. 5,458,844 and No. 5,601,048, this hull structure is rotationally moulded, preferably from a molten polyethylene powder. It includes opposing inner shell 23 and outer shell 22. These shells are integrally joined around peripheral portions thereof as shown at 21 (FIG. 3), and are also integrally joined at adjacent regions within this periphery by a plurality of horizontally spaced and longitudinally extending stiffening members 24. These stiffening members are integrally joined to and extend between the inner shell 23 and outer shell 22 (as best shown in FIG. 3), establish a generally hollow volume hull, with the stiffening members 24 recessed within the hollow volume and projecting upwardly towards the open region of the hollow volume defined by the hull.

Each of the longitudinally extending members 24 is generally of an inverted U-shaped cross-section with the spaced arms 27 of the "U" extending vertically upwards and the central connecting section 25 of the "U" extending in a generally horizontal direction. Extending downward from the gunwale 32 at the uppermost portion of the hull is a generally vertically extending wall 29. The riser 28 of the inner shell is at the lower terminus of wall 29 and provides a horizontally inwardly projecting ledge, the purpose of which will be subsequently discussed. The aft end of the boat also advantageously includes one or more reinforcing gussets 36, which is the subject of pending application Ser. No. 08/595,290 of Feb. 1, 1996.

The integrally formed liner section 30 includes a generally vertical wall 32 extending downwardly along at least a portion of the periphery of the liner, and a generally extending bottom wall 34 spanning between opposed lower edges of the peripheral vertical wall 32. The area enclosed by walls 32,34 establishes a unitary seamless boat floor. The liner 30 also includes a forward, generally planar section 31 configured to align with the bow of the hull. A cutout 33 is provided for the hatch and starboard hatches 62 may also be included. The integral liner 30 is preferably formed of fiber-reinforced plastic. However, it should be understood that other thermoplastic moldable materials can be used, which may be fabricated according to well-known vacuum forming or roto-moulding processes.

The securement of the liner 30 to hull 20 includes peripheral securement 42 to the riser 28 by an appropriate sealant/adhesive. Where the hull 20 is formed of rotationally moulded polyethylene and the liner 30 is fiber-reinforced plastic, a suitable adhesive that may be used is Rule Elastomeric 300 white, obtained from Rule Industries, Gloucester, Mass. It should naturally be understood that other sealant adhesives may be used to provide an appropriate hermetic seal, with the particular adhesive being selected in accordance with the particular plastics utilized for the hull 20 and liner 30. To provide additional securement, self-tapping screws 65 may additionally be inserted at spaced locations along the periphery.

Figure 4:
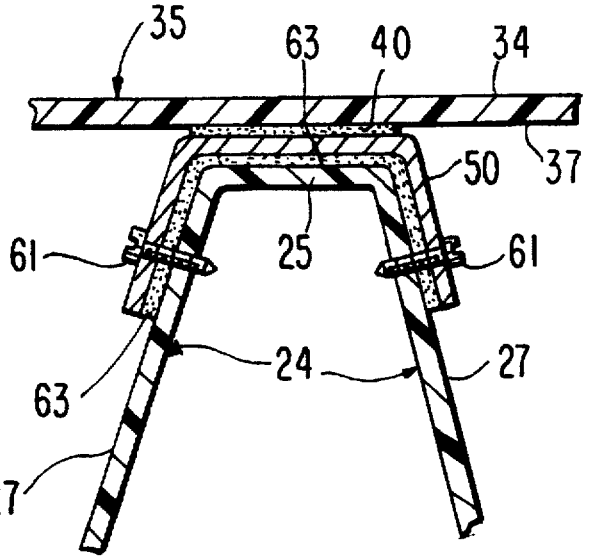
FIG. 4 is an enlargement of the cross-sectional portion, shown by the circular region A of FIG. 3.

The bottom wall 34 of the liner, includes an outer surface 35 and an inner surface 37. Preferably the outer surface 35 of the floor will be made non-skid by appropriate modification of its surface characteristics by grooving, or the moulding-in of frictional elements, in the well-known manner. Inner surface 37 advantageously abuts the horizontal surface 25 of the longitudinal extending hull stiffening members 24, preferably along the entire length of the bottom wall 34. Hence, the hull stiffening members 24 will operatively support the bottom wall. Inner wall surface 37 is advantageously also adhesively secured to surface 25 of the longitudinal supporting member, as best shown in FIG. 4. Should the hull 20 and liner 30 be of two different plastic materials, an inverted U-shaped saddle 50 is preferably interposed between the longitudinal supporting surface 25 and the inner surface 37 of the liner bottom wall 34. Saddle 50, which may be formed of the same material as liner 30 (e.g., fiber-reinforced plastic), is adhesively secured to the longitudinal supporting member by adhesive 63 which may be the same adhesive as 42. The longitudinal extent of the saddle 50 should correspond to the longitudinal extent of the liner bottom wall 34, so as to provide enhanced adhesive securement therebetween along the entire longitudinal extent of the bottom wall 34. To provide for further securement of the saddle and improved load dissipation, self-tapping screws 61 will be spaced along the longitudinal extent of the saddle. The top surface 63 of saddle 50 is adhesively secured to bottom wall surface 37 by an adhesive 40. Inasmuch as adhesive 40 is being used to adhesively secure the same plastic materials (fiber-reinforced plastic), a different adhesive may be used. One adhesive which has been found to be particularly useful is Polybond, a polyester-base bonding putty available from ATC Chemical Corporation, Buffalo, N.Y. It is, however, understood that other adhesives may be used in accordance with the particular plastic materials selected for the fabrication of the parts forming the instant boat structure. Further, should the liner 30 be formed of a thermoplastic which can be suitably bonded to surface 25 of the longitudinally extending boat hull reinforcing members without the interposition of the saddle 50, the saddle can be deleted.

Referring to FIGS. 5 and 6, the completed boat, which may be typically on the order of 15 to 20 feet (although the boat sizes may be fabricated in accordance with the teachings of the present invention) includes an outboard motor 70, storage hatches 62 and seating generally shown as 72. The seats 72 are supported on a base 73, which is secured to the floor surface 35 of the liner. For example the bottom wall 34 of the liner may have an intermediate wooden layer embedded therein to which the base 73 be attached by self tapping screws (not shown). Battery 71 may be located as shown in FIG. 5. Railings 70 and cleats 77 may also secured to the hull in the well-known manner. Advantageously, the gas tanks (not shown) may be placed between the longitudinally extending stiffening members 24 prior to the placement of liner 30 within the hull 20.

It should readily be understood that various modifications to both the hull and liner structures can be made thereto without departing from the scope of the present invention as defined in the appended claims.

What is claimed is:

1. A moulded boat including first and second members:

said first member being an integrally moulded plastic boat hull structure comprising opposing inner and outer shells which are integrally joined around peripheral portions thereof and which are also integrally joined at adjacent regions within said periphery by a plurality of horizontally spaced and longitudinally extending stiffening members, integrally joined to and extending between said inner shell and outer shell, to establish a generally hollow volume hull, with said stiffening members recessed within the hollow volume and projecting upwardly towards the open region of the hollow volume;

said second member being an integrally formed liner, nested within the hollow volume of said hull, said liner including a generally vertical wall extending downwardly along at least a portion of the periphery of said liner and a generally horizontally extending bottom wall spanning between opposed lower edges of the peripheral vertical wall;

said bottom wall having opposed inner and outer surfaces, said inner surface abutting at least a portion of generally horizontally extending surfaces at the terminus of said hull stiffening members, with said hull stiffening members operatively supporting said bottom wall; and securement means for fixedly securing said liner to said hull to provide a unitary boat structure.

2. A moulded boat hull structure according to claim 1, wherein said securement means including means for establishing a hermetic seal between said liner and hull.

3. A moulded boat hull structure according to claim 2, wherein said hermetic seal includes an adhesive sealant between the periphery of said liner and wall surface of the hull inner shell opposed thereto.

4. A moulded boat hull structure according to claim 1, wherein said longitudinal stiffening members having an inverted U-shaped cross section with the spaced arms of the "U" extending vertically upwards, and the central connecting section of the "U" extending in a generally horizontal direction; and the bottom wall of said liner is secured to said central connecting section.

5. A moulded boat hull structure according to claim 4, wherein said securement means includes bonding means for attaching the bottom wall of said liner to the central connecting sections of a plurality of said longitudinal stiffening members.

6. A moulded boat hull structure according to claim 4, wherein the bottom wall of said liner forms a unitary seamless boat floor.

7. A moulded boat hull structure according to claim 6, wherein said liner further includes a boat seating section as an integral portion thereof.

8. A moulded boat hull structure according to claim 6, wherein said liner further includes an outboard motor mounting section as an integral portion thereof.

9. A moulded boat hull structure according to claim 4, further including an inverted U-shaped saddle interposed between the bottom wall of said liner and the portions of the longitudinal stiffening members connected to said bottom wall.

10. A moulded boat hull structure according to claim 9, wherein said hull, including the longitudinal stiffening members formed of a first plastic material, and said liner and saddle formed of a second plastic material, and said sealant means including a first adhesive between a) the periphery of said liner and the opposed wall surfaces of said hull, and b) said saddle and longitudinal stiffening members, and a second adhesive between said saddle and the bottom wall of said liner.

11. A moulded boat hull structure according to claim 9, further including a plurality of screws connecting each of said saddles to its respective longitudinal stiffening member.

12. A moulded boat hull structure according to claim 1, wherein said hull is rotationally moulded from molten polyethylene powder and said liner is formed of fiber reinforced plastic.

13. A moulded boat hull structure according to claim 9, wherein the longitudinal extent of each of said saddles corresponds to the longitudinal extent of said bottom wall.

14. A moulded boat hull structure according to claim 6, wherein the unitary floorboard provided by the bottom wall of said liner includes a skid-resistant outer surface.

15. A moulded boat hull structure according to claim 1, wherein said longitudinal stiffening members having an inverted "U" cross-section with the spaced arms of the "U" extending vertically upwards, and the central connecting section of the "U" extending in a generally horizontal direction;

the bottom wall of said liner secured to said central connecting section; and further including an inverted U-shaped saddle interposed between the bottom wall of said liner and the portions of the longitudinal stiffening members connected to said bottom wall.

16. A moulded boat hull structure according to claim 15, wherein the longitudinal extent of each of said saddles corresponds to the longitudinal extent of said bottom wall.

17. A moulded boat hull structure according to claim 15, further including a plurality of screws connecting each of said saddles to its respective longitudinal stiffening member.

18. A moulded boat hull structure according to claim 15, wherein said hull, including the longitudinal stiffening members formed of a first plastic material, and said liner and saddle formed of a second plastic material, and said sealant means including a first adhesive between a) the periphery of said liner and the opposed wall surfaces of said hull, and b) said saddle and longitudinal stiffening members, and a second adhesive between said saddle and the bottom wall of said liner.

19. A moulded boat hull structure according to claim 18, wherein said hull is rotationally moulded from molten polyethylene powder and said liner is formed of fiber reinforced plastic.

20. A moulded boat hull structure according to claim 3, wherein the vertical wall surface of the hull inner shell includes a first portion extending vertically downward from the open end of the hull and a horizontally inwardly projecting riser ledge at the lower terminus of said first portion, said riser ledge providing a vertical stop and peripheral support for the liner, and the peripheral hermetic seal is between the periphery of said liner and said riser ledge.

* * * * *